US008630441B2

(12) United States Patent
Shi et al.

(10) Patent No.: US 8,630,441 B2
(45) Date of Patent: Jan. 14, 2014

(54) MULTI-MAGNETIC SPEAKER

(75) Inventors: Lei Shi, Shenzhen (CN); Wen-Tao Jiang, Shenzhen (CN); Xiong Zhang, Shenzhen (CN); San-You Wu, Shenzhen (CN); Lin-Zhen Li, Shenzhen (CN)

(73) Assignees: AAC Acoustic Technologies (Shenzhen) Co., Ltd., Shenzhen (CN); American Audio Components Inc., La Verne, CA (US)

( * ) Notice: Subject to any disclaimer, the term of this patent is extended or adjusted under 35 U.S.C. 154(b) by 14 days.

(21) Appl. No.: 13/325,622

(22) Filed: Dec. 14, 2011

(65) Prior Publication Data

US 2012/0177245 A1 Jul. 12, 2012

(30) Foreign Application Priority Data

Jan. 6, 2011 (CN) ..... 2011 2 0002720 U

(51) Int. Cl.
*H04R 1/00* (2006.01)
*H04R 9/06* (2006.01)
*H04R 11/02* (2006.01)

(52) U.S. Cl.
USPC ..... 381/398; 381/401; 381/412; 381/420

(58) Field of Classification Search
USPC ..... 381/396, 398, 400, 401, 402, 407, 408, 381/412, 420, 421
See application file for complete search history.

(56) References Cited

U.S. PATENT DOCUMENTS

| | | | | |
|---|---|---|---|---|
| 2007/0140521 | A1* | 6/2007 | Mitobe et al. | 381/420 |
| 2007/0165887 | A1* | 7/2007 | Shin et al. | 381/152 |
| 2008/0031487 | A1* | 2/2008 | Sorensen et al. | 381/396 |
| 2011/0293133 | A1* | 12/2011 | Yan | 381/401 |
| 2012/0008816 | A1* | 1/2012 | Liu et al. | 381/401 |

* cited by examiner

*Primary Examiner* — Duc Nguyen
*Assistant Examiner* — Sean H Nguyen
(74) *Attorney, Agent, or Firm* — Anova Law Group, PLLC

(57) ABSTRACT

A multi-magnet speaker is disclosed. The multi-magnet speaker includes a frame defining a hollow space, a magnetic system defining a yoke and a plurality of magnetic gaps positioned in the hollow space, a diaphragm mounted on the frame and a plurality of coils attached to the bottom of the diaphragm. The diaphragm includes a plurality of vibrating membranes each defining a dome part and an arcuate portion radially extending from the periphery of the dome part. Each of the coils is received in the corresponding magnetic gap to drive the corresponding vibrating membrane to vibrate.

6 Claims, 2 Drawing Sheets

MULTI-MAGNETIC SPEAKER

FIELD OF THE INVENTION

The present disclosure relates to transducers to be mounted in terminal equipments for converting electrical signals to audible sounds, and more particularly to a multi-magnet speaker.

DESCRIPTION OF RELATED ART

Sound which can be heard by a person's auditory sense is transmitted in the form of waves. The sound having the wave form moves air molecules and vibrates the tympanic membrane, thus allowing a person to hear the sound. In order to provide audible sounds, various kinds of speakers have been developed. The speaker is generally coupled to audio equipment or an amplifier for use as a large sound producing means for considerably amplifying volume. Alternatively, the speaker may be used as a small sound producing means having a small size and volume.

As such, the small-sized speaker may be mounted to a small electronic product, such as a mobile phone, a PDA, or a notebook computer. As the wireless age begins, consumers want to enjoy various contents regardless of time and place and demand portability of the electronic product. In order to satisfy the consumers' desires, speakers are tending towards miniaturization and lightness.

A speaker related to the present disclosure includes a holder defining a sound hole, a frame attached to the holder for forming a chamber, a strait magnetic circuit defining a magnetic gap, a wicker-shaped diaphragm located in the chamber, and a voice coil attached to the bottom of the diaphragm. Typically, the magnetic circuit includes a yoke, a magnet positioned on the yoke, and a top plate attached to the magnet. The magnetic gap is formed between the yoke and the magnet, and the voice coil is partially suspended in the magnetic gap. While electrified, the voice coil will be activated to vibrate by the electromagnetic Ampere Force and further drives the diaphragm to vibrate, which converts the electrical signals to sound waves. For speakers with a long and narrow diaphragm, vibration along the major-axis of the diaphragm is not balanced as just one coil is used to drive the diaphragm, which affects the sound quality of the micro speaker.

Therefore, it is desirable to provide a speaker which can overcome the above-mentioned problems.

Figure 1:
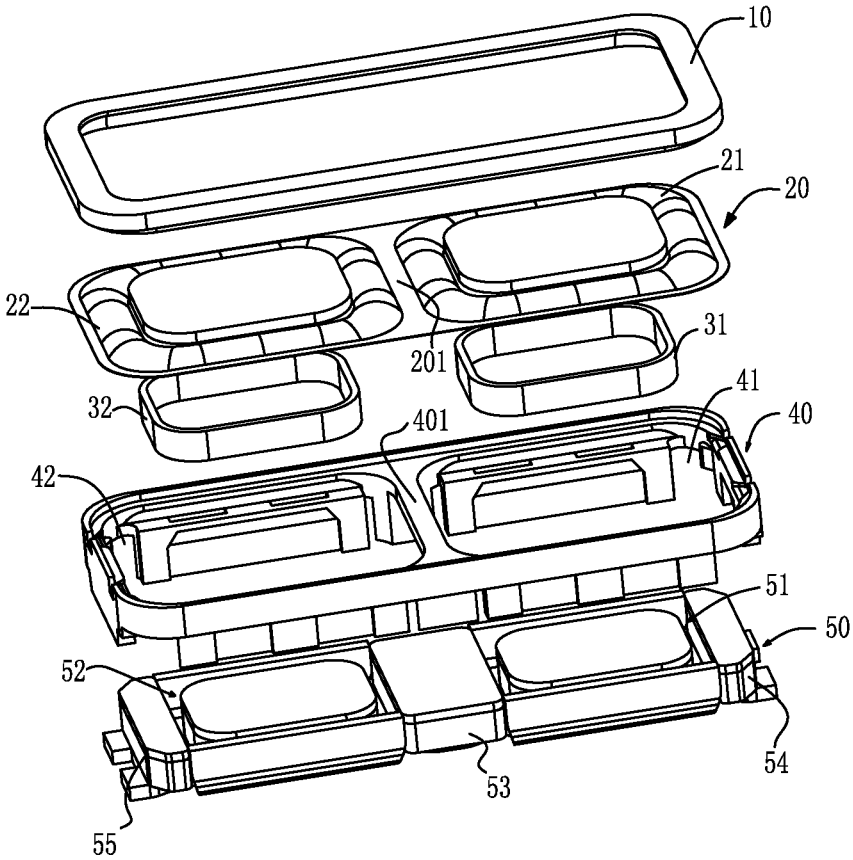
FIG. 1 is an isometric exploded view of a multi-magnet speaker in accordance with an exemplary embodiment of the present invention.

Many aspects of the embodiment can be better understood with reference to the drawings mentioned above. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPALRY EMBODIMENT

Reference will now be made to describe an exemplary embodiment of the present disclosure in detail.

Figure 2:
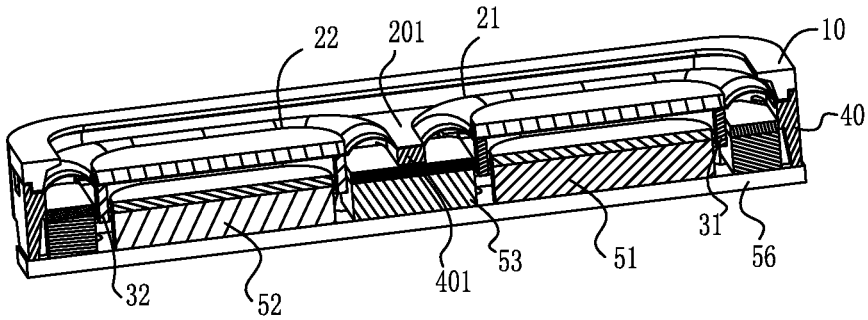
FIG. 2 is a cross-sectional view of the multi-magnet speaker in FIG. 1.

Referring to FIGS. 1-2, a multi-magnet speaker comprises a frame 40 forming at least one hollow space, a magnetic system 50 mounted on the frame 40 and defining a plurality of magnetic gaps, a diaphragm 20 defining a plurality of vibrating membranes 21, 22, and a fixing cover 10 covered on a peripheral of the diaphragm 20 for fixing the diaphragm 20 on the frame 40 firmly. Each of the vibrating membranes 21, 22 is connected with a coil. Each of the coils defines an end suspended in the magnetic gap and another end connected with the vibrating membrane. In fact, the coils can be directly connected to the diaphragm, and can also be connected to the diaphragm via a medium. In this exemplary embodiment, the frame 40 defines a brace 401 at a middle portion thereof for forming a first hollow space 41 and a second hollow space 42. However, the amount of the hollow spaces is not limited or restricted to two, and according to different desires, amount of the hollow spaces can be various.

Figure 3:
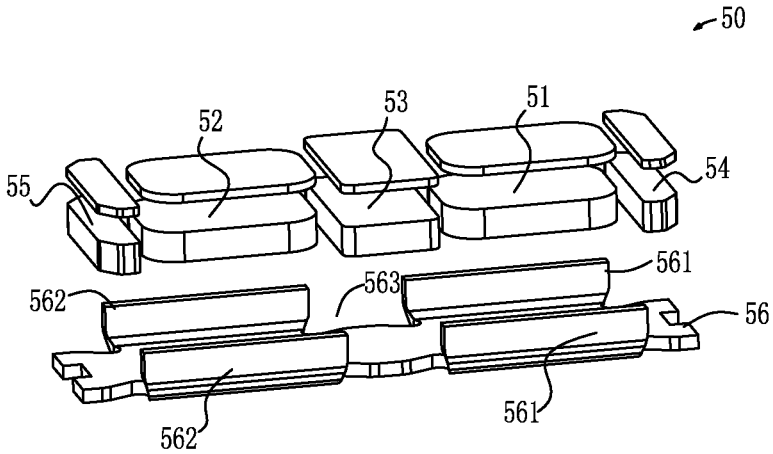
FIG. 3 is an isometric exploded view of a magnetic system of the multi-magnet speaker in FIG. 1.

Referring to FIGS. 2-3, the magnetic system 50 comprises a yoke 56 defining a receiving cavity, at least two main magnets received in the receiving cavity of the yoke 56, and a plurality of pole plates respectively attached to surfaces of the main magnets. In this exemplary embodiment, a first main magnet 51 and a second main magnet 52 locates in the receiving cavity, and a mid-magnet 53 lies between the first main magnet 51 and the second main magnet 52. The magnetic system 50 further comprises a first auxiliary magnet 54 located at an end of the yoke 56, and a second auxiliary magnet 55 located at the other end of the yoke 56.

The yoke 56 defines a bottom, at least two pairs of longitudinal sidewalls extending upwardly and perpendicularly from the longitudinal periphery of the bottom. The receiving cavity is formed by the bottom and the longitudinal sidewalls. In this exemplary embodiment, the yoke 56 defines a pair of first longitudinal sidewalls 561, a pair of second longitudinal sidewalls 562, and a groove 563 located between the first longitudinal sidewalls 561 and the second longitudinal sidewalls 562 for accommodating the mid-magnet 53. When assembled, the first main magnet 51 is located between the two first longitudinal sidewalls 561, and the second main magnet 52 is located between the two second longitudinal sidewalls 562.

Figure 4:
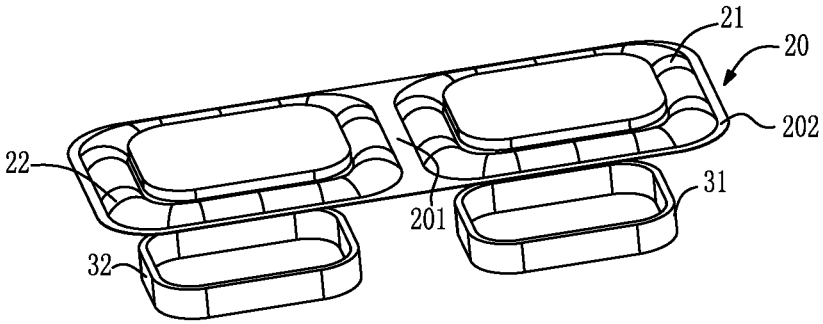
FIG. 4 is an isometric view of a diaphragm ready to be attached with a pair of voice coils of the multi-magnet speaker in FIG. 1.

Each of the vibrating membranes defines a dome part and an arcuate portion radially extending from the periphery of the dome part. The coils connect to the peripheries of the dome parts, respectively. Referring to FIG. 4, together with FIG. 1, the diaphragm 20 further comprises a connecting part 201 corresponding to the brace 401 for connecting the first vibrating membrane 21 and the second vibrating membrane 21. An edge 202 extends outwardly from a circumference of the first vibrating membrane 21 and second vibrating membrane 22. A first coil 31 is attached to the first vibrating membrane 21. A second coil 32 is attached to the second vibrating membrane 22.

While assembled, referring to FIG. 1 and FIG. 2, the first coil 31 is partially suspended in the first hollow space 41, and the second coil 32 is partially suspended in the second hollow space 41. The edge 202 of diaphragm 20 is fixed to the frame 40 and is pressed by the fixing cover 10. The connecting part 201 connects to the brace 401. When electrified, the first coil 31 and the second coil 32 synchronously drive the first vibrating membrane 21 and the second vibrating membrane 22 to vibrating, respectively. By virtue of the two magnetic circuits, the two membranes, the two coils connected to the two membranes, and the connecting part connecting with the brace of the frame, vibration of the diaphragm is balanced, which improves the sound performance of the speaker.

Be noted that even though the multi-magnetic speaker in the exemplary embodiment is provided with two vibrating membranes and two coils, the disclosure is not limited to the configuration described above. In fact, the multi-magnetic speaker may be provided with three or more vibrating membranes and coils.

While the present disclosure has been described with reference to the specific embodiment, the description of the disclosure is illustrative and is not to be construed as limiting the disclosure. Various of modifications to the present disclosure can be made to the exemplary embodiment by those skilled in the art without departing from the true spirit and scope of the disclosure as defined by the appended claims.

What is claimed is:

1. A multi-magnet speaker, comprising:

a frame defining a hollow space and a brace at a middle portion thereof;

a magnetic system received in the hollow space and defining a yoke and a plurality of magnetic gaps; the yoke defining a bottom wall, a plurality of sidewalls extending upwardly from the periphery of the bottom wall and a groove formed in a middle portion of the yoke;

a diaphragm mounted on the frame and defining a plurality of vibrating membranes, each of the vibrating membrane defining a dome part and an arcuate portion radially extending from the periphery of the dome part;

a plurality of coils each defining an end suspended in the magnetic gap and another end connected with the vibrating membrane, respectively;

wherein the diaphragm further defines a connecting part fixed to the brace of the frame and an edge fixed to a periphery of the frame; and wherein the magnetic system further defines a plurality of main magnets each located between two opposed sidewalls, a plurality of mid-magnets located between two adjacent main magnets, and two auxiliary magnets attach to two ends of the yoke.

2. A multi-magnet speaker, comprising:

a frame defining a first hollow space and a second hollow space;

a magnetic system defining a yoke and two magnetic gaps, the yoke defining a bottom wall, a pair of first sidewalls and a pair of second sidewalls extending upwardly and perpendicularly from the longitudinal outer periphery of the bottom wall, and a nick located between the first sidewalls and the second sidewalls;

the magnet system further defining a first main magnet located between the first sidewalls, a second main magnet located between the second sidewalls, a mid-magnet located on the nick between the first main magnet and second main magnet, a first auxiliary magnet mounted on one end of yoke, and a second auxiliary magnet mounted on the other end of the yoke;

a diaphragm mounted on the frame and defining a first vibrating membrane and a second vibrating membrane, each of the first vibrating membrane and the second vibrating membrane defining a dome part and an arcuate portion radially extending from the periphery of the dome part;

a first coil attached to the first vibrating membrane;

a second coil attached to the second vibrating membrane;

a middle portion of the diaphragm connected to a middle portion of the frame.

3. The multi-magnetic speaker as described in claim 2, wherein the diaphragm further comprises a connected part located between the first vibrating membrane and the second vibrating membrane, and an edge extending outwardly from a circumference of the first vibrating membrane and the second vibrating membrane for being fixed to the frame.

4. The multi-magnetic speaker as described in claim 3, wherein the frame includes a brace connected with the connected part.

5. The multi-magnetic speaker as described in claim 1, wherein the mid-magnets are positioned right below the brace of the frame.

6. The multi-magnetic speaker as described in claim 3, wherein the mid-magnet is positioned right below the brace.

* * * * *